US005947876A

United States Patent [19]

Willey, II

[11] Patent Number: 5,947,876

[45] Date of Patent: Sep. 7, 1999

[54] ABDOMINAL RANGE OF MOTION EXERCISE

[76] Inventor: J. Warren Willey, II, 9259 E. Raintree, #1032, Scottsdale, Ariz. 85260

[21] Appl. No.: 09/006,464

[22] Filed: Jan. 13, 1998

Related U.S. Application Data

[60] Provisional application No. 60/036,266, Jan. 22, 1997.

[51] Int. Cl.[6] ..... A63B 23/02

[52] U.S. Cl. ..... 482/140; 482/123; 482/132; 482/142

[58] Field of Search ..... 482/92, 93, 95, 482/96, 105, 121–123, 129, 130, 133, 134, 139, 140, 141, 142, 908; 297/16.1, 17, 25, 26, 354.12, 377, 378.1, 378.12, 452.21, 452.25, 452.3, 452.31, 452.32; D21/662, 673, 676, 686–691; D6/367, 368

[56] References Cited

U.S. PATENT DOCUMENTS

| | | | |
|---|---|---|---|
| D. 152,394 | 1/1949 | Ceverha | D21/662 |
| D. 348,491 | 7/1994 | Diep | D21/662 |
| 1,455,234 | 5/1923 | Thompson | 297/452.25 |
| 2,308,410 | 1/1943 | Winter | 297/377 |
| 3,145,054 | 8/1964 | Sopko, Jr. | 297/452.3 |
| 3,276,817 | 10/1966 | Marple | 297/148 |
| 3,532,378 | 10/1970 | Dalia | 297/118 |
| 3,664,666 | 5/1972 | Lloyd . | |
| 3,947,023 | 3/1976 | Martin . | |
| 4,136,868 | 1/1979 | Hogue . | |
| 4,595,234 | 6/1986 | Kjersem | 297/452.3 |
| 4,609,192 | 9/1986 | Bratcher | 482/142 |
| 4,944,508 | 7/1990 | Collins | 482/92 |
| 4,968,029 | 11/1990 | Cossin . | |
| 5,125,650 | 6/1992 | Paris . | |
| 5,163,737 | 11/1992 | Navach et al. | 297/452.25 |
| 5,368,537 | 11/1994 | Felice . | |
| 5,441,473 | 8/1995 | Safani et al. . | |
| 5,647,829 | 7/1997 | Rivas | 482/140 |
| 5,803,884 | 9/1998 | Sharp | 482/142 |

*Primary Examiner*—Jeanne M. Clark
*Attorney, Agent, or Firm*—Joseph N. Breaux

[57] ABSTRACT

An exercise device comprising a carrying case/base unit, an adjustable inclined back support member; a retractable buttocks support; and a pair of trackways, one pivotally mounted to the carrying case/base unit on either side of the retractable buttocks support. Each of the pair of trackways includes a handle slidable along a respective trackway that is biased in a first direction by an elastomeric resistance band.

3 Claims, 3 Drawing Sheets

ABDOMINAL RANGE OF MOTION EXERCISE

This application claims the benefits under 35 U.S.C. 119(e) of earlier filed provisional application number 60/036,266, filed Jan. 22, 1997.

TECHNICAL FIELD

The present invention relates to exercise devices and more particularly to an exercise device for the abdomen muscles that includes an angularly adjustable inclined back support that includes a lumbar spine support that keeps the low back in it's natural anatomical position of lordosis throughout the most stressful portion of the exercise that is pivotally mounted to a carrying case/base unit and a retractable contoured buttocks support extendable from the carrying case/base unit and positioned adjacent to the lowest side of the inclined back support. The inclined back support and the retractable contoured buttocks support are storable within the carrying case/base unit for easy transportation and storage. If desired a pair of collapsible trackways each having an elastomeric resistance band attached to a slidable handle are provided adjacent to the retractable contoured buttocks support to provide a second mode of exercise for the user. A third modality may be incorporated that consists of a seat rest that moves in designated tracking in a semi-lunar manner, that enables the user to isolate and completely and efficiently exercise the lower abdominal muscles.

BACKGROUND OF INVENTION

Proper abdominal exercises must often be tailored to the fitness level of the person required to perform them. For instance, a person with a low fitness level benefit more from performing abdominal exercise while inclined at a greater angle than a person having a higher level of fitness. It would be a benefit, therefore, to have an abdominal exercise device that required the user to utilize only the abdominal muscles while performing the exercise and allowed the user to position an inclined back support that includes a lumbar spine support that keeps the low back in it's natural anatomical position of lordosis throughout the most stressful portion of the exercise at the desired angle of inclination based on the user's fitness level.

In addition, it is often difficult when exercising with an inclined back support to maintain the buttocks at the proper location to obtain the proper benefit from the inclined back support. It would be a benefit, therefore, to have an abdominal exercise device having a user adjustable inclined back support that also included a buttocks support in connection with the inclined back support that maintained the buttocks of the user in the proper location to obtain the maximum benefit from using the inclined back support.

In addition, because exercise devices can be cumbersome to move and store, it would be a further benefit to have an abdominal exercise device having an inclined back support and a buttocks support wherein the inclined back support and the buttocks support could be stored in a convenient carrying case for storage and transportation of the exercise device.

SUMMARY OF INVENTION

It is thus an object of the invention to provide an abdominal range of motion exercise device that requires the user to utilize only the abdominal muscles while performing the exercise and allows the user to position an inclined support that includes a lumbar spine support that keeps the low back in it's natural anatomical position of lordosis throughout most of the stressful portion of the exercise at the desired incline angle based on the user's fitness level.

It is a further object of the invention to provide an abdominal range of motion exercise device having a user adjustable inclined back support that also includes a buttocks support in connection with the inclined back support to maintain the buttocks of the user in the proper location to obtain the maximum benefit from using the inclined back support.

It is a further object of the invention to provide an abdominal range of motion exercise device having an inclined back support and a buttocks support wherein the inclined back support and the buttocks support are storable in a convenient carrying case for storage and transportation of the exercise device It is a still further object of the invention to provide an abdominal range of motion exercise device that accomplishes all or some of the above objects in combination.

Accordingly, an abdominal range of motion exercise device is provided. The exercise device comprises a carrying case/base unit having a handle extending from an outer surface thereof, a storage chamber formed with the carrying case/base unit having a bracket adjusting bar secured along a bottom interior surface thereof, the bracket adjusting bar including a plurality of spaced parallel notches formed along the length thereof; an adjustable inclined back support member including a support plate that is pivotally mounted at one end thereof to the carrying case/base unit, a bracket member having a first bracket end pivotally connected to a first side surface of the support plate and a second bracket end insertable into the spaced parallel notches of the bracket adjusting bar in a manner such that the support plate is inclined at a different angle when the second bracket end is positioned into each of the spaced parallel notches, a contoured back support cushion being provided on a second surface of the support plate; and a retractable buttocks support having a contoured buttocks support cushion having a first and a second buttocks receiving depression formed therein, the contoured buttocks support cushion being slidable into the storage chamber of the carrying case/base unit.

In use, the user positions the carrying case/base unit onto a suitable exercise surface such as a floor, lifts the adjustable inclined back support member to a desired angle, and then the second bracket end is positioned into a spaced parallel notch to support the adjustable inclined back support member at the desired angle. The buttocks support is then pulled from the storage chamber and the exercises performed. In a preferred embodiment a pair of trackways are provided, one on each side of the buttocks support. Each trackway is provided with a handle slidable along the trackway and biased in a first direction by an elastomeric resistance band. A third modality may be incorporated that consists of a seat rest that moves in designated tracking, in a semi-lunar manner, that enables the user to isolate and completely and efficiently exercise the lower abdominal muscles.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

the user adjustable inclined back support; and the retractable buttocks support.

Figure 1:
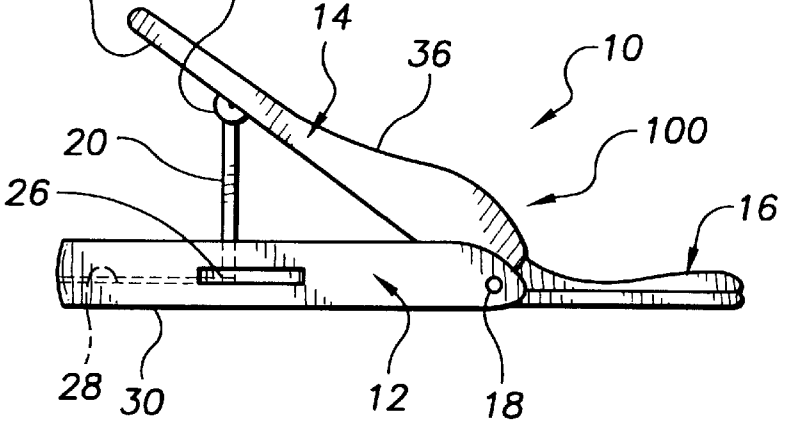
FIG. 1 is a side plan view of a first exemplary embodiment of the present invention showing the carrying case/base unit.
Figure 2:
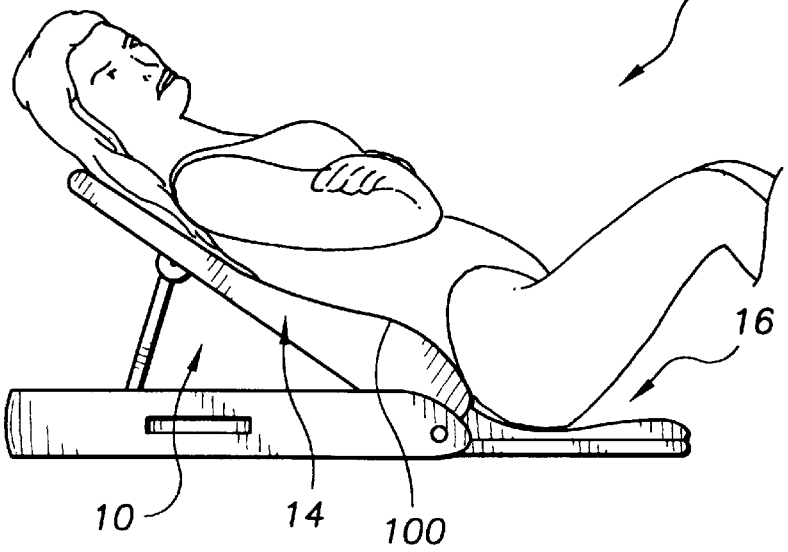

FIG. 2 is a side plan view of the abdominal exercise device of FIG. 1 in use with the buttocks and back of a representative user positioned onto the buttocks support and inclined back support, respectively.

Figure 3:
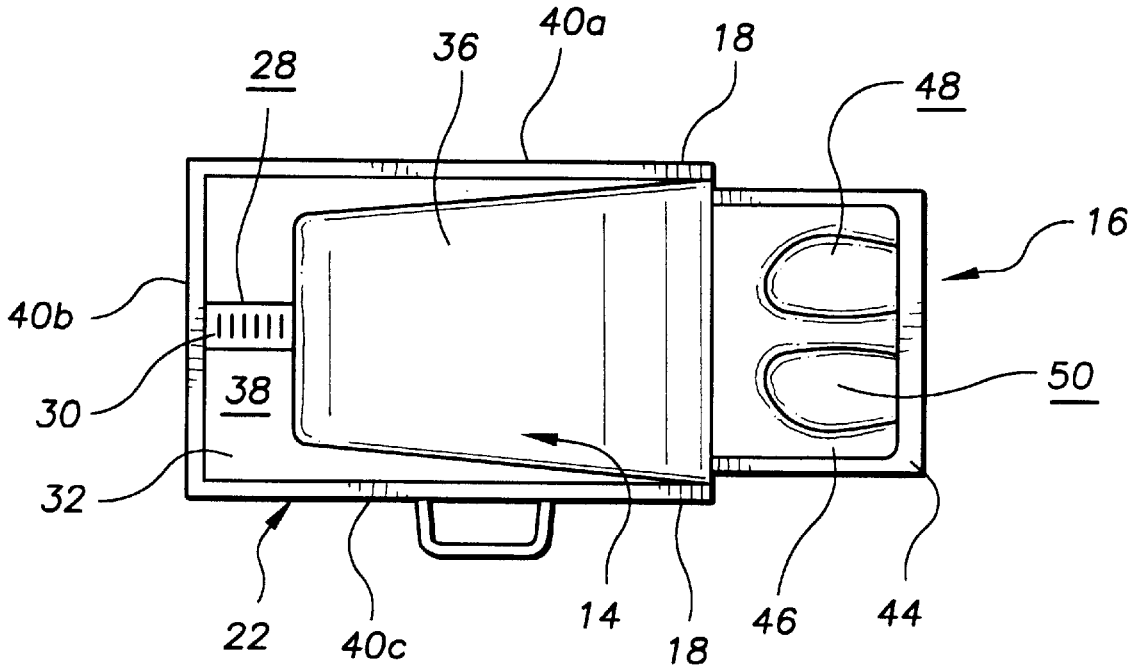

FIG. 3 is a top view of the abdominal exercise device of FIG. 1 showing the contoured back support surface of the inclined back support, the bracket member, the handle, and the contoured surface of the buttocks support including the left and right buttocks depressions.

Figure 4:
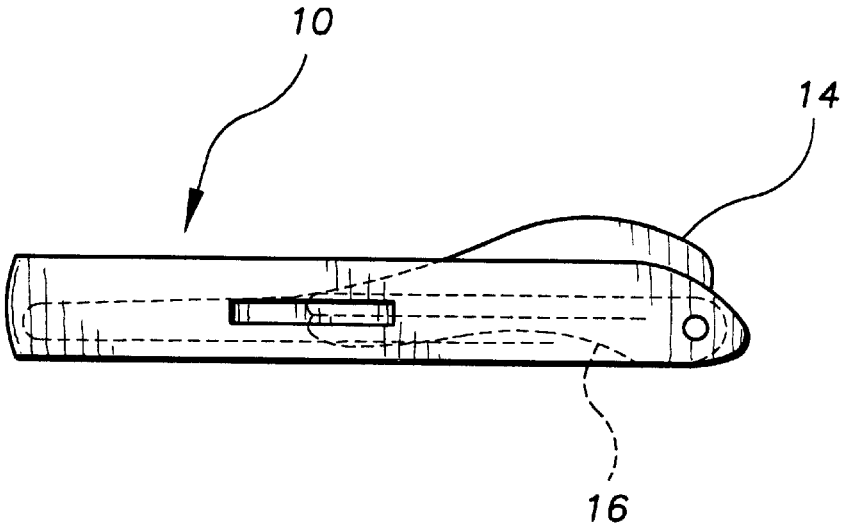

FIG. 4 is a side plan view of the abdominal exercise device of FIG. 1 with the inclined back support and retractable buttocks support stored within the carry case/base unit.

Figure 5:
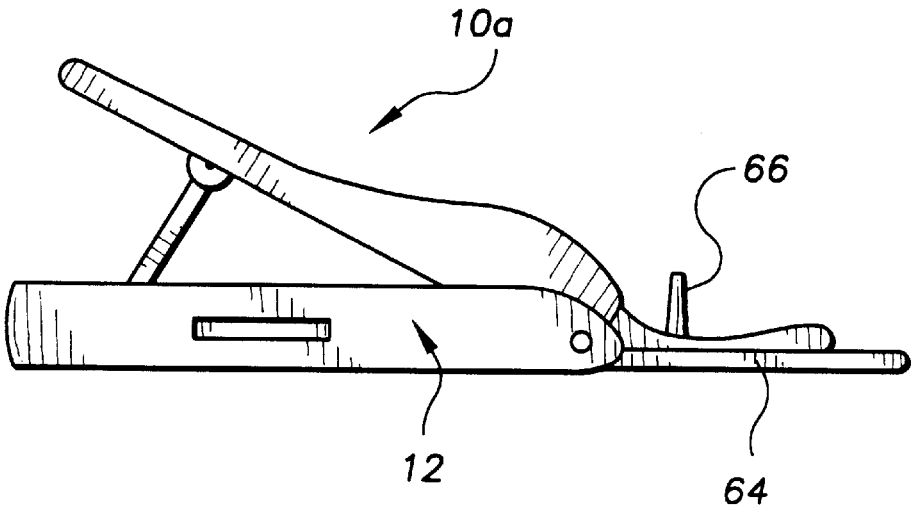

FIG. 5 is a side plan view of a second exemplary embodiment of the abdominal exercise device of the present invention that includes a pair of handles positioned within trackways located on either side of the buttocks support that are attached to elastomeric resistance bands to provide an addition exercise modality if desired.

Figure 6:
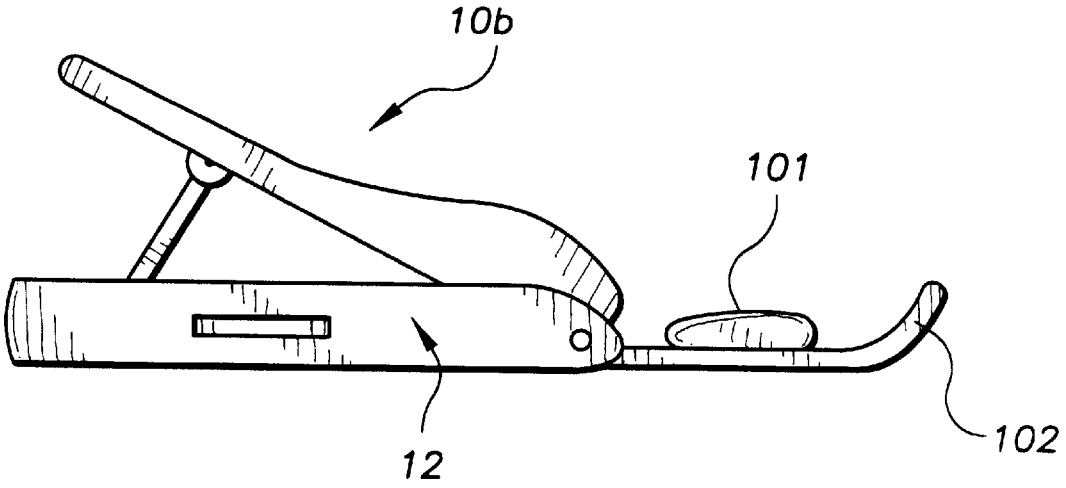

FIG. 6 is a side plan view of a third exemplary embodiment of the abdominal exercise device of the present invention that includes a seat rest movable along and guided by a pair of semi-lunar shaped tracks.

EXEMPLARY EMBODIMENTS

FIG. 1 shows a first exemplary embodiment of the abdominal range of motion exercise device of the present invention generally designated by the numeral 10. Exercise device 10 includes a carrying case/base unit, generally designated by the numeral 12; a user adjustable inclined back support, generally designated by the numeral 14, back support 14 having a low back support 100 for supporting the low back of the user; and a retractable buttocks support, generally designated by the numeral 16. Inclined back support 14 is pivotally mounted to carrying case/base unit 12 by a pair of pivot pins 18 (both shown in FIG. 3) to allow inclined back support 14 to pivot to a desired angle. A bracket member 20 is pivotally connected to the underside surface 22 of inclined back support 14 at one bracket end 24 thereof. A second bracket end 26 is positionable within one of a number of notches 28 formed along a bracket adjustment bar 30 secured to the interior bottom surface 32 (FIG. 3) of carrying case/base unit 12. This allows the user to set inclined back support 14 at a desired exercise angle selected based upon the fitness level of the person exercising.

With reference to FIG. 3, an upper surface 36 of inclined back support 14 is covered with plastic foam cushioning and is contoured to support the back of the exercising person. Carrying case/base unit 12 has a storage compartment 38 defined therein by sidewalls 40*a*,40*b*,40*c*, and interior bottom surface 32. Inclined back support 14 is pivotally mounted between sidewalls 40*a*,40*c* and is sized to pivot into storage compartment 38 for storage.

Buttocks support 16 includes a bottom plate 44 and a contoured buttocks support cushion 46. In this embodiment bottom plate 44 is constructed from rigid plastic and buttocks support cushion 46 is constructed from resilient plastic foam. Buttocks support cushion 46 is provided with a left and a right buttocks receiving depression 48,50 for receiving and holding the buttocks of the person exercising. Providing buttocks receiving depressions 48,50 provides a secure seating location to prevent sliding of the person exercising from movements and perspiration resulting from the exercise. FIG. 4 shows exercise device 10 configured for transporting and/or storage with inclined support 14 pivoted into and retractable buttocks support 16 slidably positioned into storage compartment 38. FIG. 2 shows a representative person 60 using exercise device 10 with the back supported on inclined support 14 and the buttocks securely supported on buttocks support 16.

FIG. 5 shows a second exemplary exercise device, generally designated by the reference 10*a*. Exercise device 10*a* is identical to exercise device 10 except a pair of trackways 64 (only one show) are pivotally connected to the exterior of carrying case/base unit 12. Each trackway 64 is provide with a slidable handle 66 that is biased by an elastomeric resistance band. Each slidable handle 66 provides an additional exercise modality by enabling added resistance for use by the exerciser as desired.

FIG. 6 shows a third exemplary embodiment of the abdominal exercise device of the present invention, generally designated by the numeral 10*b*. In this embodiment a sliding seat rest 101 is provided that is movable along and guided by a pair of identical semi-lunar shaped tracks 102 (only one shown) that extend from carrying case/base unit 12. Each semi-lunar shaped track 102 having a greater angle of curvature as the distance from carrying case/base unit 12 increases. Sliding seat rest 101 is moveably restricted to travel along semi-lunar shaped tracks 102 in a semi-lunar manner. Use of a sliding seat rest 101 in combination with semi-lunar tracks 102 allows the user to isolate and completely and efficiently exercise the lower abdominal muscles.

It can be seen from the preceding description that an abdominal range of motion exercise device has been provided that requires the user to utilize only the abdominal muscles while performing the exercise, that allows the user to position an inclined support at the desired inclination angle based on the user's fitness level; that includes a buttocks support in connection with an inclined back support that includes a lumbar spine support that keeps the lower back in its natural anatomical position of lordosis throughout the most stressful portion of the exercise; and that includes an inclined back support that includes a lumbar spine support that keeps the lower back in its natural anatomical position of lordosis throughout the most stressful portion of the exercise and a buttocks support that are storable in a convenient carrying case for storage and transportation of the exercise device.

It is noted that the embodiment of the abdominal range of motion exercise device described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. An abdominal range of motion exercise device comprising:

a carrying case/base unit having a handle extending from an outer surface thereof, a storage chamber formed within said carrying case/base unit having a bracket adjusting bar secured along a bottom interior surface thereof, said bracket adjusting bar including a plurality of spaced parallel notches formed along said length thereof;

an adjustable inclined back support member including a support plate that is pivotally mounted at one end thereof to said carrying case/base unit, a bracket member having a first bracket end pivotally connected to a first side surface of said support plate and a second bracket end insertable into said plurality of spaced parallel notches of said bracket adjusting bar in a manner such that said support plate is inclined at a different angle when said second bracket end is positioned into each of said spaced parallel notches, a second surface of said support plate having a contoured lumbar spine support cushion provided thereon;

a retractable buttocks support having a contoured buttocks support cushion having a first and a second buttocks receiving depression formed therein, said contoured buttocks support cushion being slidable into said storage chamber of said carrying case/base unit; and a pair of trackways, one pivotally mounted to said carrying case/base unit on either side of said retractable buttocks support, each of said pair of trackways including a handle slidable along a respective said trackway and biased in a first direction by an elastomeric resistance band.

2. An abdominal range of motion exercise device comprising:

a carrying case/base unit having a handle extending from an outer surface thereof, a storage chamber formed within said carrying case/base unit having a bracket adjusting bar secured along a bottom interior surface thereof, said bracket adjusting bar including a plurality of spaced parallel notches formed along said length thereof;

an adjustable inclined back support member including a support plate that is pivotally mounted at one end thereof to said carrying case/base unit, a bracket member having a first bracket end pivotally connected to a first side surface of said support plate and a second bracket end insertable into said plurality of spaced parallel notches of said bracket adjusting bar in a manner such that said support plate is inclined at a different angle when said second bracket end is positioned into each of said spaced parallel notches, a second surface of said support plate having a contoured lumbar spine support cushion provided thereon;

a retractable buttocks support having a contoured buttocks support cushion having a first and a second buttocks receiving depression formed therein, said contoured buttocks support cushion being slidable into said storage chamber of said carrying case/base unit; and a track system extending from said carrying case/base unit, in a semi-lunar manner, said track system having a greater angle of curvature as the distance from the carrying case/base unit increases; and wherein said retractable buttocks support includes a seat rest supporting said contoured buttocks support cushion that is moveably restricted to travel along said track system.

3. The abdominal range of motion exercise device of claim 2, further including:

a pair of trackways, one pivotally mounted to said carrying case/base unit on either side of said retractable buttocks support, each of said pair of trackways including a handle slidable along a respective said trackway and biased in a first direction by an elastomeric resistance band.

* * * * *